United States Patent [19]

Vosters

[11] Patent Number: 4,707,968

[45] Date of Patent: Nov. 24, 1987

[54] METHOD AND APPARATUS FOR WRAPPING PRESSURE SENSITIVE ROLLS OF MATERIAL

[75] Inventor: Joseph P. Vosters, Green Bay, Wis.

[73] Assignee: Appleton Papers Inc., Appleton, Wis.

[21] Appl. No.: 886,432

[22] Filed: Jul. 17, 1986

[51] Int. Cl.[4] ..... B65B 11/04

[52] U.S. Cl. ..... 53/430; 53/118; 242/56.4; 242/56.9

[58] Field of Search ..... 53/430, 118, 119, 117, 53/116, 204, 587; 242/56.9, 56.4, 79

[56] References Cited

U.S. PATENT DOCUMENTS

| | | | |
|---|---|---|---|
| 3,521,424 | 7/1970 | Wirfel | 53/430 X |
| 3,718,302 | 2/1973 | Mount et al. | 242/56.9 X |
| 4,055,313 | 10/1977 | Yamaguchi et al. | 242/56.4 |
| 4,131,206 | 12/1978 | Kawada et al. | 242/79 X |
| 4,458,853 | 7/1984 | Heymanns | 242/56.4 |
| 4,498,276 | 2/1985 | Reed | 53/204 X |
| 4,608,807 | 9/1986 | Skripalle | 53/430 X |

*Primary Examiner*—James F. Coan

*Attorney, Agent, or Firm*—Birch, Stewart, Kolasch & Birch

[57] ABSTRACT

An apparatus and process for foam wrapping pressure sensitive rolls of material in a limited amount of space with a minimum amount of handling of the pressure sensitive rolls. The apparatus includes an intermediate transfer cart and a retractable foam application unit. The intermediate transfer cart operates to receive unwrapped rolls of pressure sensitive material from a winder unit and transport it to a position underneath the foam application unit which custom wraps various widths of pressure sensitive rolls of material from one full width of foam web while providing a driving force to turn the pressure sensitive rolls as foam is being applied thereto.

20 Claims, 11 Drawing Figures

METHOD AND APPARATUS FOR WRAPPING PRESSURE SENSITIVE ROLLS OF MATERIAL

BACKGROUND OF THE INVENTION

1. Field of the Invention

The present invention relates to foam wrapping pressure sensitive rolls of material. More particularly, this invention relates to the wrapping of pressure sensitive rolls with the foam application unit and intermediate transfer cart in order to confine a foam wrapping operation in a limited amount of space with a minimum amount of manual handling.

2. Description of Related Art

Due to a demand in the industry, there is a need to wrap pressure sensitive rolls in layers of foam in order to facilitate manual handling without damaging the pressure sensitive material. Currently, the industry is either manually wrapping or semiautomatically wrapping pressure sensitive rolls which requires considerable machine downtime and/or labor. In particular, pressure sensitive rolls are customarily hand wrapped with foam after pressure sensitive material has been wound onto shafts at a winder station, and some businesses feed foam through the winder to provide foam wraps for the material.

SUMMARY OF THE INVENTION

Accordingly, it a the primary object of the present invention to provide an apparatus and process for foam wrapping pressure sensitive rolls of material in a limited amount of space with a minimum amount of manual handling.

The objects of the present invention are fulfilled by providing winding means for winding a plurality of rolls of pressure sensitive material on winder shafts, the plurality of rolls being separated by spacers on each shaft, intermediate transfer cart means for accepting the winder shafts from the winding means, means for transferring the plurality of pressure sensitive rolls from the winding means to the intermediate transfer cart, and foam application means for applying a layer of foam to the plurality of pressure sensitive rolls on the intermediate transfer cart.

The intermediate transfer cart includes two integral scissor-lift tables for raising and lowering the plurality of rolls on the winder shafts, roll pedestals mounted on the transfer cart for supporting the shafts, and means for adjusting the proximity or distance between the two winder shafts.

In addition, the foam application unit is retractable from an operative position slightly above and between the plurality of pressure sensitive rolls to an inoperative position above the intermediate transfer cart. Further, the foam application unit can custom-wrap various widths of pressure sensitive rolls from one full width foam web while providing a driving force to turn the pressure sensitive rolls as foam is being applied thereto.

Advantages of the present system over other proposed systems include a minimal amount of travel for "naked" (unwrapped) pressure sensitive rolls. Once the pressure sensitive rolls are foam wrapped, they can be rolled and handled as non-pressure sensitive rolls. Also, operators of the machine will be in close proximity to all functions as they occur. All rolls of both shaft sets are wrapped simultaneously from one full width of foam web, and the device has the ability to handle dual yardage demands. Due to the efficiency of the system, there is a minimal amount of foam waste and a much smaller amount of premium space is required than in conventional systems.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only and, thus, are not limitative of the present invention, and wherein.

DETAILED DESCRIPTION OF PREFERRED EMBODIMENTS

Figure 1:
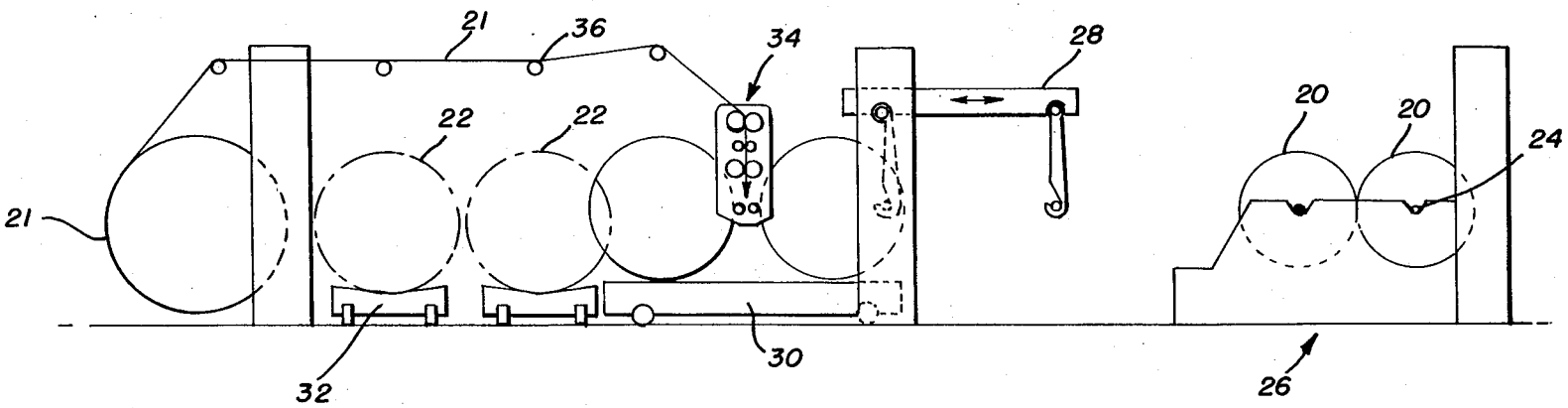
FIG. 1 is a side elevational view of a foam wrapping apparatus of the present invention.

FIG. 1 is a side elevational view of the foam wrapping apparatus of the present invention. Shown as 26 in FIG. 1 is a winder unit on which two center core shafts 24 are positioned. Each center core shaft 24 receives thereon a roll of pressure sensitive material generally shown as 20. A bi-directional six-hook hoist 28 is operable to pick up two core shafts 24 having pressure sensitive material 20 thereon and transfer them from the winder unit 26 to an intermediate transfer cart 30. The bi-directional hoist moves along the ceiling (structure not shown) from a position over the winder unit 26 to a position over the intermediate transfer cart 30 when the cart is adjacent the winder unit. Positioned above intermediate transfer cart 30 is a retractable foam applicating unit 34, the foam being supplied from a full width of foam wrap 21 over a plurality of foam guides 36. At least two roll transfer carts 32 are provided to receive foam wrapped pressure sensitive rolls 22 thereon for transfer to a remote location.

Figure 2:
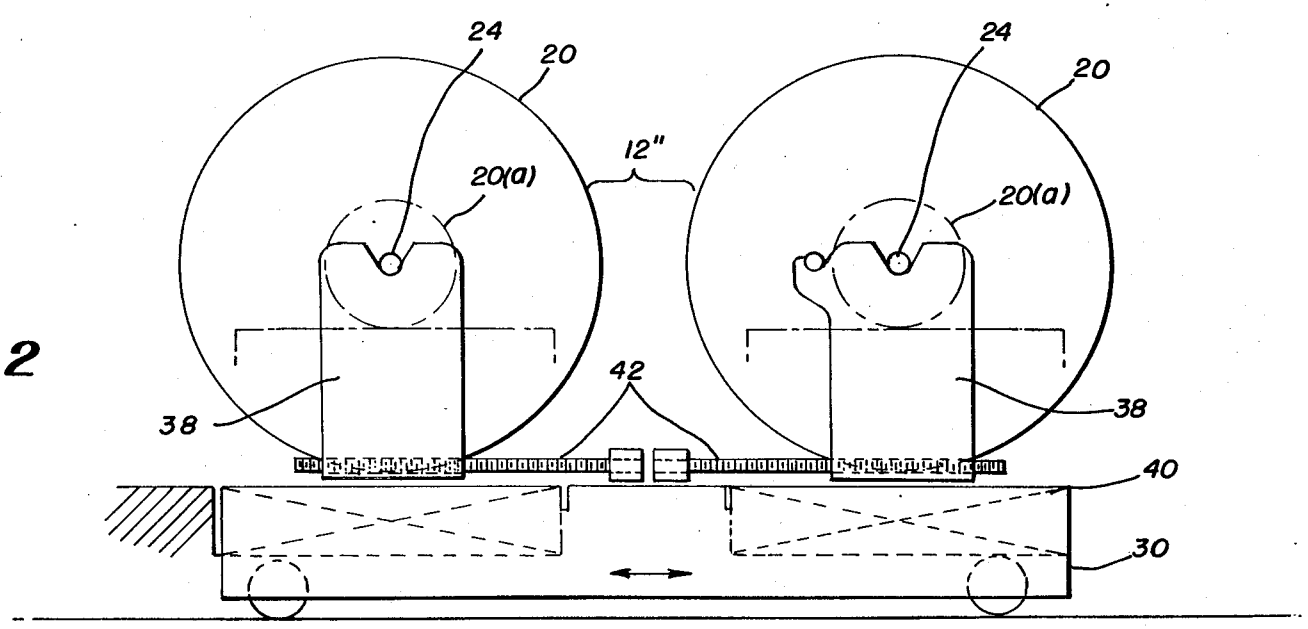
FIG. 2 is a cross-sectional side view of an intermediate transfer cart of FIG. 1.

FIG. 2 is a cross-sectional side view of the intermediate transfer cart of FIG. 1. The intermediate transfer cart 30 accepts the two winder shaft sets 24 from the six-hook hoist 28. The cart 30 is then transferred to an area under the foam application unit (not shown in FIG. 2) such that roll pedestals 38 position the winder rolls 20 next to rider rolls of the foam application unit. In particular, the intermediate transfer cart is preferably located approximately six feet further from the winder unit 26 when positioned underneath the foam application unit. Roll pedestals 38 on the intermediate transfer cart 30 are automatically moved closer together until the roll edge is about six inches from the center of the cart (in other words, rolls are twelve inches apart). Movement is facilitated by lead screws 42 for adjusting the distance between roll centers. Subsequent to a foam application procedure, both scissor-lift tables 40 on the intermediate transfer cart 30 lift their respective rolls slightly from the roll pedestals in order to facilitate shaft removal from all rolls. After shafts are removed, the scissor-lift tables 40 are lowered so that foam wrapped rolls may be manually rolled onto roll transfer carts 32 or to a conveyor (not shown). The intermediate transfer cart 30 is at this time returned to a home position at the winder unit 26 for loading of the next set of rolls.

Figure 4:
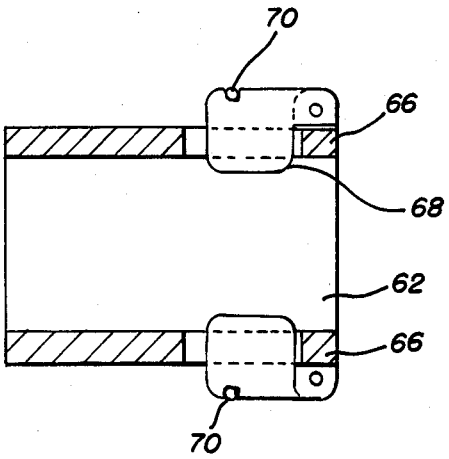
FIG. 4 is an exploded view of a clutch/drive coupling of FIG. 3.
Figure 3:
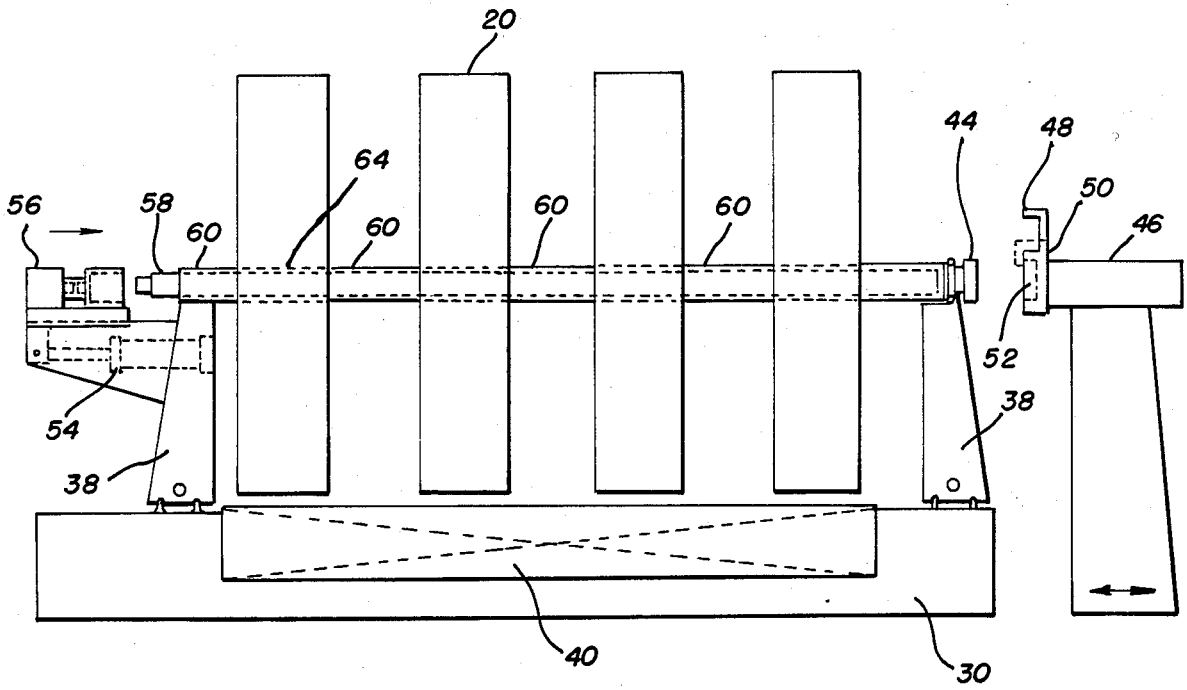
FIG. 3 is a front view of a core shaft drive assembly of the intermediate transfer cart shown in FIG. 2.

FIG. 3 is a front view of the core shaft drive assembly of the intermediate transfer cart shown in FIG. 2 and FIG. 4 is an exploded view of a clutch/drive coupling shown in FIG. 3. The core shaft 58 is fitted with a plurality of spacers 60 and cores 64, the plurality of pressure sensitive rolls 20 being positioned at cores 64. An air cylinder 54 is provided for enabling core shaft loading, the air cylinder 54 being mounted to roll pedestal 38. At the time of loading, an air motor 56 for driving the core shaft is positioned by air cylinder 54 such that the clutch/drive coupling 62 of the core shaft drive assembly is fitted over the exposed end of core shaft 58. Shown in connection with the clutch/drive coupling 62 of the core shaft drive assembly are abutting ends 66 of the core shaft motor, driving "dogs" 68 for key-ways of the core shaft, and garter springs 70 associated with driving dogs 68. Subsequent to a winding operation, a core shaft puller 46 is engaged with the drive end 44 of the core shaft 58 such that the recessed portion 52 receives the drive end 44 therein and a securing mechanism 48 fastens over the drive end of the core shaft by movement at hinge 50.

Figure 5:
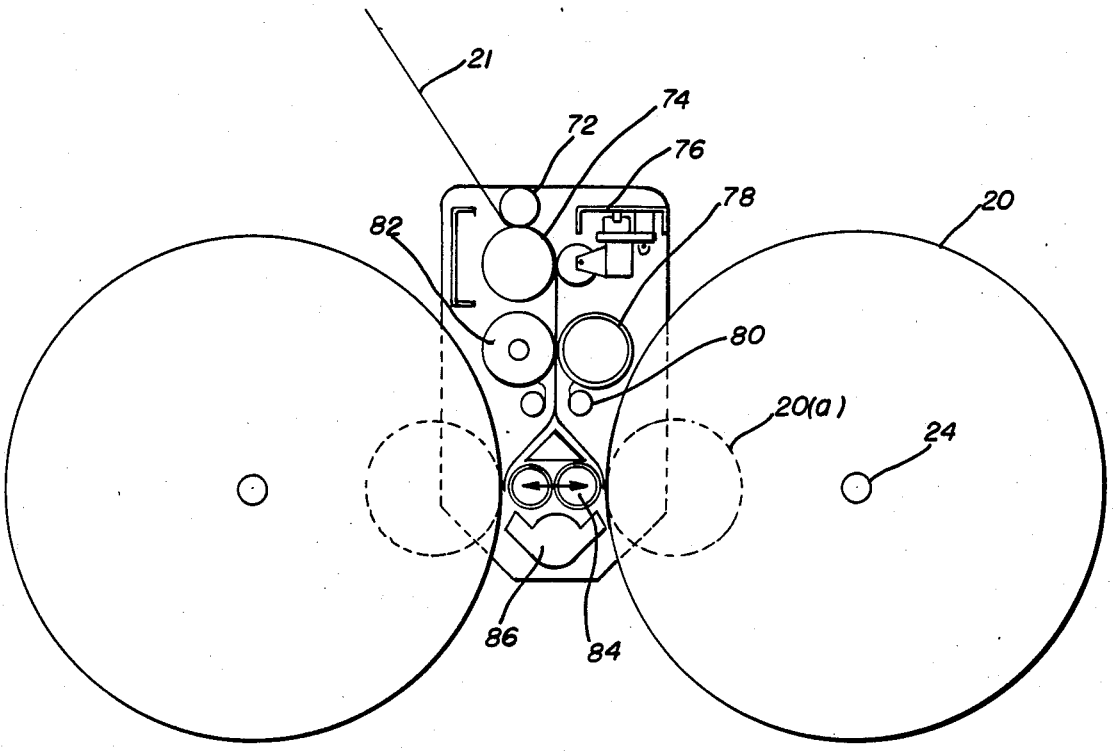
FIG. 5 is a preferred embodiment showing a cross-sectional view of the retractable foam applicator unit of the present invention.

FIG. 5 is a preferred embodiment showing a cross-sectional view of the retractable foam applicator unit of the present invention. A sheet of foam 21 is received from the full width of foam wrap and is fed through an idler roll 72 against a hardened anvil backing roll 74 toward a slitter 76, at which point the full width of foam 21 is slit into custom widths according to a computerized slitting system 76 which instructs the slitter to provide custom widths corresponding to those of the pressure sensitive rolls 20. Each of the plurality of custom width slit foam is deflected in a direction opposite an adjacent width of foam. By this deflection, alternate widths of foam are fed toward appropriate rolls of pressure sensitive material on each of the two roll shafts. A typical spacing of custom widths of pressure sensitive material is more clearly shown in FIGS. 7 and 9. A rubber covered roll 78 is geared to a knife ejector roll 82, the custom width foam being fed therethrough. A selective glue system 80 applies glue to the tail end of the alternately deflected foam after it is wound onto respective pressure sensitive rolls 20. Dual rider rolls 84 apply a minimum nip pressure against the pressure sensitive rolls. The foam drive rolls and core shafts are driven to provide the desired number of foam wraps. A trim pickup hopper 86 will catch any excess length of foam therein.

Figure 6:
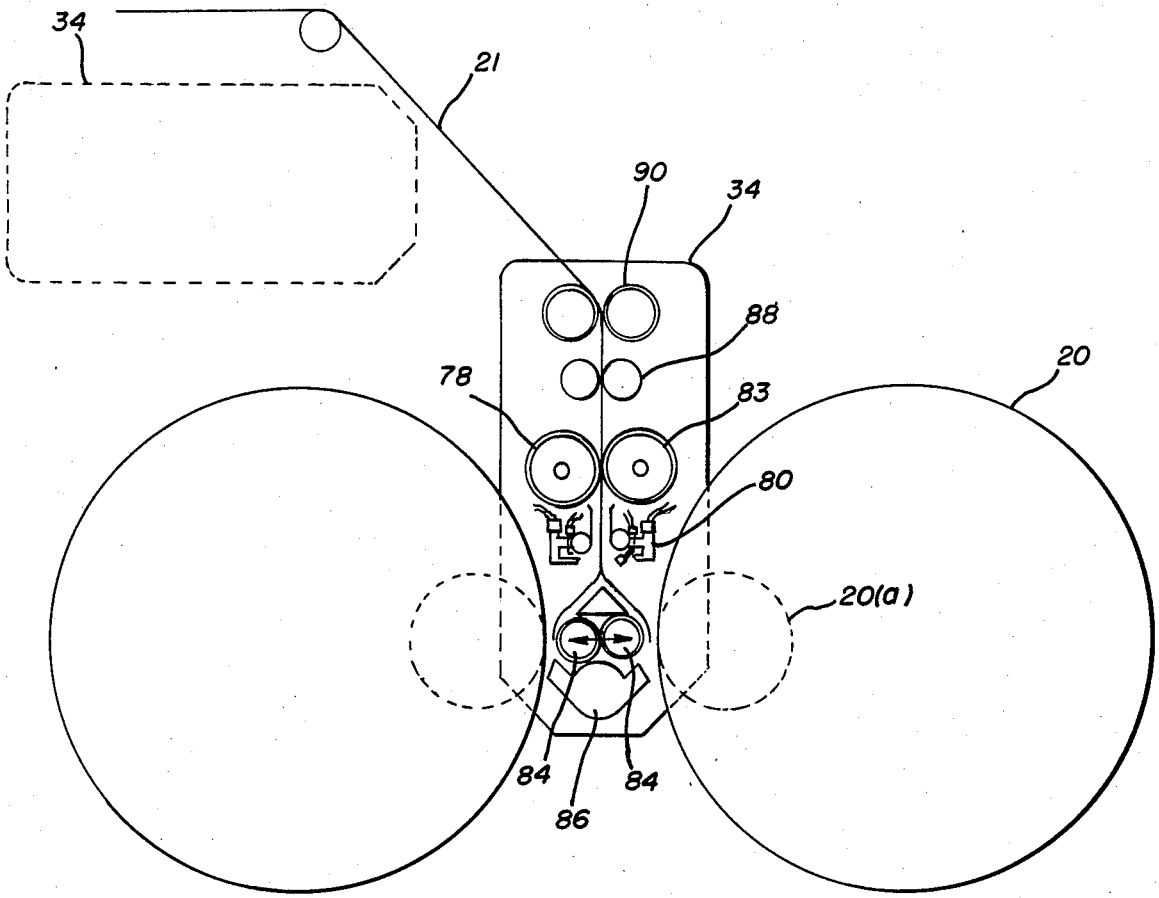
FIG. 6 is a second preferred embodiment showing a cross-sectional view of the retractable foam applicator unit of the present invention.

FIG. 6 is a second preferred embodiment showing a cross-sectional view of the retractable foam applicator unit of the present invention. The full width foam wrap 21 passes through dual rubber covered hold-back rolls 90 and through a computerized slitting system 88. A rubber covered backing roll 78 and rubber covered knife ejector roll 83 terminate the length of foam being passed therethrough when a predetermined portion has been wrapped around pressure sensitive rolls 20. A selective glue system 80 applies glue to the tail end of the alternately deflected custom width foam wrap at the completion of the wrapping procedure. Dual rider rolls 84 provide a minimum amount of nip pressure against the pressure sensitive rolls 20. The rider rolls also aid in rotation of the pressure sensitive rolls in order to apply the custom width foam. Trim pickup hopper 86 once again collects the scraps left from foam 21.

Figure 7:
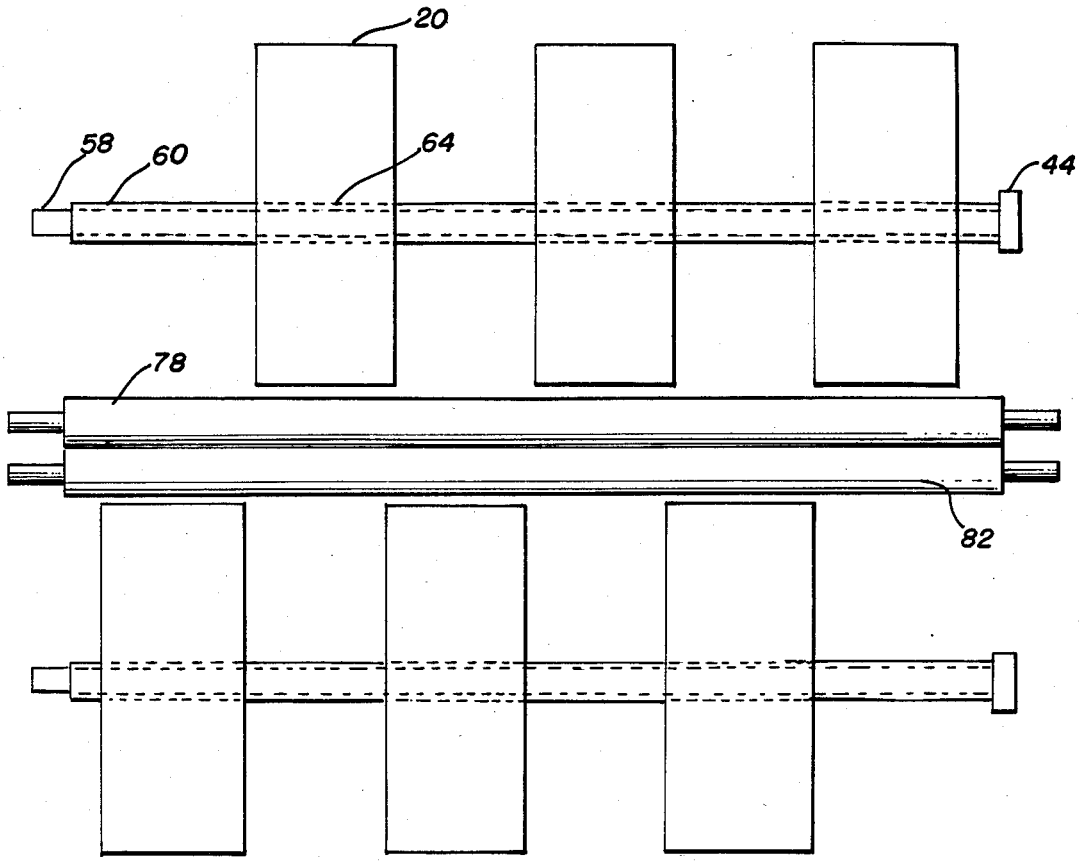
FIG. 7 is a top plan view of a pull roll/knife roll combination of the foam applicator unit of FIG. 5.

FIG. 7 is a top plan view of the pull roll/knife roll combination of the foam applicator unit of FIG. 5. Covered roll 78 and knife ejector roll 82 are seen positioned between a set of custom width pressure sensitive rolls 20 loaded onto core shaft 58. Core shaft 58 is a long shaft upon which the rolls of pressure sensitive material are wound. Equal length cores 64 and spacers 60 are placed on the shaft 58 prior to the pressure sensitive material. The cores 64 are typically of cardboard and are 3 inches inner diameter by 4.32 inches outer diameter and are approximately the width of pressure sensitive roll 20. The spacers 60 are typically 3 inches inner diameter by 4 inches outer diameter and of various lengths of steel or plastic. When a full width web of foam wrap material is slit, every other roll is wound upon the other shaft as shown in FIG. 7. The pressure sensitive paper is wound upon the cardboard core 64 at the winder unit 26, the foam being subsequently slit and wound over the pressure sensitive paper.

Figure 8:
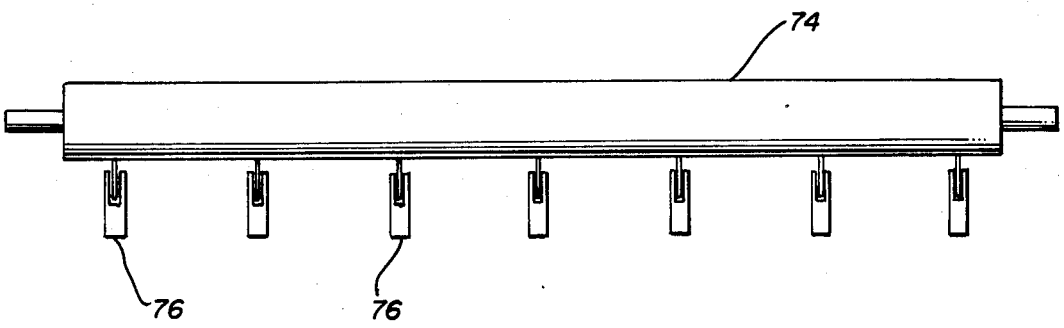
FIG. 8 is a top plan cross-sectional view of a backing roll and slitter of the foam applicator unit of FIG. 5.

FIG. 8 is a top plan cross-sectional view of the backing roll and slitter of the foam applicator unit of FIG. 5. A hardened steel backing roll 74 is positioned against slitter 76 which has a plurality of slitter assemblies 76A which cuts the foam 21 into desired custom widths. The slitter holder is commercially available as a Tidland Corporation No. EK-30 knife holder with necessary modifications to adapt it to the present invention. If automatic slitter positioning is utilized, two Festo Corporation DGO rodless cylinders and a Temposonics Incorporated Linear Displacement Transducer are required.

Figure 9:
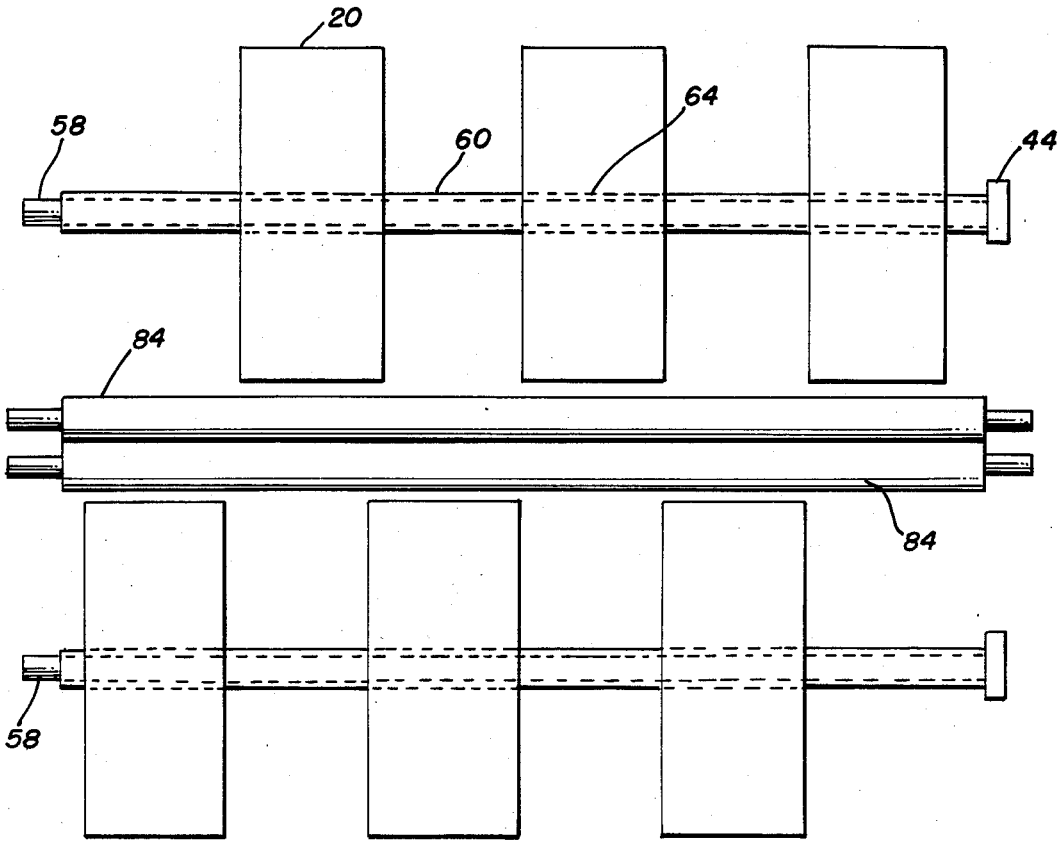
FIG. 9 is a top plan cross-sectional view of rider rolls of FIGS. 5 and 6.

FIG. 9 is a top plan cross-sectional view of the rider rolls of FIGS. 5 and 6. Dual retractable rider rolls 84 are positioned between the plurality of pressure sensitive rolls alternately spaced along each of two core shafts 58. These rider rolls 84 are driven in order to turn the large paper rolls on their shafts, thus wrapping foam webs around the circumference of the pressure sensitive paper rolls 20 which are then protected from exterior damage.

Figure 10:
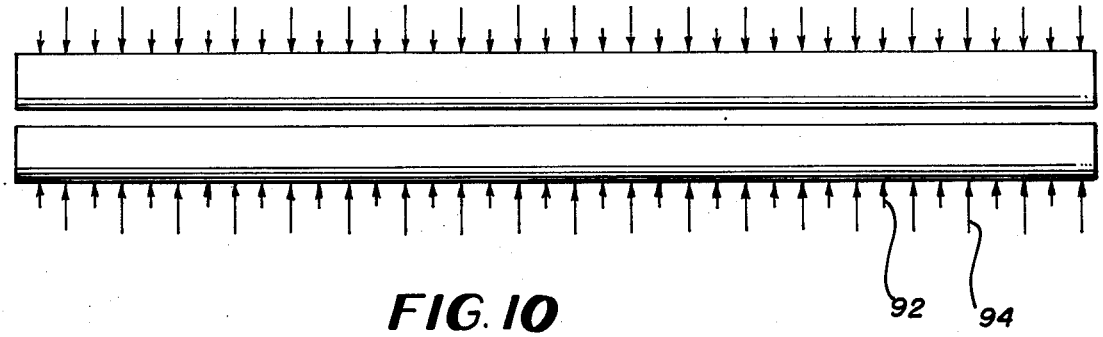
FIG. 10 is a sectional view through air diverters and glue nozzles of FIG. 6.
Figure 11:
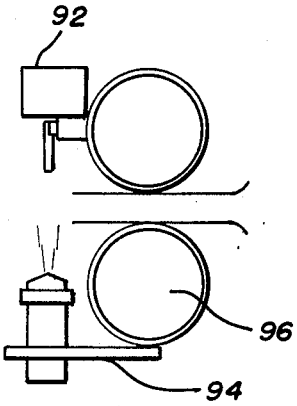
FIG. 11 is an enlarged side view of the air diverters and glue nozzles of FIG. 10.

FIG. 10 is a sectional view through the air diverters and glue nozzles of FIG. 6, and FIG. 11 is an enlarged side view of the air diverters and glue nozzles of FIG. 10. In particular, air diverters are shown at 92, and selective glue nozzles are shown at 94 in FIG. 10 and are positioned along the length of parallel core shafts 58 such that the custom widths of foam wrap 21 delivered from knife ejector rolls and backing rolls are selectively deflected toward an appropriate pressure sensitive roll 20, with glue being applied to the tail end of a foam piece. At 96 are shown selective air headers for assisting in the selective application of glue to the tail end of the foam wrap 21. Mechanical flippers or other means instead of air diverters are also acceptable for the purpose of diverting the foam webs to one side of the inverted "V" or the other side.

DESCRIPTION OF THE OPERATION

Empty core shafts are set up on the winder with proper spacers and cores, empty shafts being picked up from the intermediate transfer cart. Both six-hook hoists are moved over the winder such that the hoist picks up a completed roll set therefrom and deposits it onto the intermediate transfer cart. The operator can then deposit the empty shafts into the winder arm so that the machine may be run.

A helper will enter the roll widths and diameters (which are different if there is dual yardage) for both the current roll set and a following roll set into the foam applicator unit. The helper will then move the intermediate transfer cart approximately six feet from the winder station to underneath the foam application unit. When the cart is in position, a start button will do the following automatically:

(a) the roll pedestals on the cart will move the rolls closer together until the roll edges are about six inches from the center of the cart, (b) the core shaft drive assembly will push the drive coupling against the end core of each shaft to provide loading, and (c) the foam application unit will extend from the ceiling until the rider rolls are even with the center line of the shaft.

A push button operation starts the foam wrapping sequence such that foam driving rolls (backing and knife ejector rolls) are stepping motor controlled to meter feed a foam web 21 into the foam application unit. The foam, after being slit by the computerized slitting system, is driven so that the leading edge is in front of the selective glue nozzles. The proper glue nozzles then shoot glue onto whichever side of foam is necessary to adhere it to its respective alternately spaced pressure sensitive roll. The selective air nozzles are then turned on while the foam is advanced so that the glued lead edges of the foam are deflected and foam feed is stopped when the foam hangs past the rider rolls.

The rider rolls apply a minimum amount of nip pressure against the pressure sensitive rolls. The foam drive rolls and core shafts are driven to provide a desired number of foam wraps, after which the slitters disengage, reset to the next roll width and reengage. The foam has been advanced to where the "slit overlap" would be in the driving nip upon which the knife ejector severs the foam. The selective glue nozzles then apply glue to the tail end of the foam and the core shafts are driven to pull the tail end from the nip and wound onto the finished rolls.

The rider rolls are then retracted and the roll pedestals are returned to their roll centers or home position. Subsequently, the foam application unit retracts to the ceiling or its original position. Another push button operation will start the unshafting/roll removal sequence. At this time, each scissor-lift table on the intermediate transfer cart will lift its respective roll slightly from the roll pedestals, and a floor mounted core shaft puller (either single or double) will pull shafts from all of the rolls. The helper then retrieves the fallen spacers and rolls the foam wrapped pressure sensitive rolls onto transfer carts weaving the rolls together. The core shaft puller returns the empty core shaft to the roll pedestals closest to the winder device. The intermediate transfer cart is then returned to its original position to restart the entire procedure.

The foam application unit of the present invention is unique in that it combines standard and nonstandard equipment to handle a delicate application of foam to pressure sensitive rolls. The intermediate transfer cart is integral to the invention in that it accepts the two winder shaft sets from existing hoists, transfers pressure sensitive rolls to an area under the foam application unit and operates in conjuction with the foam application unit in applying foam.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An apparatus for wrapping pressure sensitive rolls of material, comprising:

winding means for winding a plurality of rolls of pressure sensitive material on winder shafts, said plurality of rolls being separated by spacers on each shaft;

intermediate transfer cart means for accepting said winder shafts from said winding means, said intermediate transfer cart being movable from a location at said winding means to a foam application location;

means for transferring said plurality of pressure sensitive rolls from said winding means to said intermediate transfer cart means;

means for driving said winder shafts on said intermediate transfer cart means, wherein said plurality of pressure sensitive rolls are rotated without contacting the periphery thereof; and foam application means for applying a layer of foam to said plurality of rotated pressure sensitive rolls on said intermediate transfer cart means at said foam application location.

2. An apparatus according to claim 1, wherein said intermediate transfer cart means includes two integral lift tables for raising and lowering said plurality of rolls on said winder shafts, roll pedestals mounted on said intermediate transfer cart means for supporting said shafts, and means for adjusting the distance between said two winder shafts.

3. An apparatus according to claim 1, wherein said foam application unit means is retractable from an operative position slightly above and between said plurality of pressure sensitive rolls on said intermediate transfer cart means to an inoperative position above said intermediate transfer cart means.

4. An apparatus according to claim 1, wherein said means for transferring is a bi-directional hoist which picks up said rewinder shafts and transports them to said intermediate transfer cart means.

5. An apparatus according to claim 1, wherein said foam application unit comprises means for slitting said full width of foam wrap, means for custom wrapping various widths of pressure sensitive rolls, and means for providing a driving force to wind foam onto said pressure sensitive rolls.

6. An apparatus according to claim 1, wherein said intermediate transfer cart means includes at least one integral lift table for raising and lowering said plurality of rolls on said winder shafts, roll pedestals mounted on said intermediate transfer cart means for supporting said shafts, and means for adjusting the distance between said two winder shafts.

7. An apparatus according to claim 1, wherein said intermediate transfer cart means further includes a coreshaft puller for removing coreshafts upon completion of said foam wrapping procedure, and an air motor for driving said coreshaft to facilitate said foam wrapping of said pressure sensitive rolls.

8. An apparatus for wrapping pressure sensitive rolls of material, comprising:

winding means for winding a plurality of rolls of pressure sensitive material on winder shafts;

intermediate transfer cart means for accepting said winder shafts having rolls of pressure sensitive material thereon from said winding means;

means for transporting said plurality of pressure sensitive rolls from said winding means to said intermediate transfer cart means;

said intermediate transfer cart means including at least two integral lift tables for raising and lowering said plurality of rolls on said winder shafts;

means for driving said winder shafts on said intermediate transfer cart means, wherein said plurality of pressure sensitive rolls are rotated by said means for driving without contacting the periphery thereof; and retractable foam application means for applying a layer of foam to said plurality of pressure sensitive rolls on said intermediate transfer cart means.

9. A method for wrapping pressure sensitive rolls of material, comprising the steps of:

(a) winding a plurality of rolls of pressure sensitive material onto winder shafts;

(b) transporting said winder shafts having a plurality of rolls of pressure sensitive material thereon to an intermediate transfer cart;

(c) transferring said intermediate transfer cart to a position under a foam application unit; and (d) applying a layer of foam to said pressure sensitive rolls of material via said foam application unit.

10. The method according to claim 9, wherein said step of applying a layer of foam to said pressure sensitive material includes the steps of (a) slitting a full width of foam wrap to custom widths corresponding to predetermined widths of rolls of pressure sensitive material;

(b) applying glue to a leading edge of said custom width foam wrap;

(c) deflecting said glued leading edge of foam wrap toward a respective roll of pressure sensitive material;

(d) driving said roll of pressure sensitive material to rotate a desired number of times, thereby applying a specified number of layers of custom width foam material;

(e) severing said custom width foam wrap upon completion of said specified number of wrapping layers; and (f) applying glue to the trailing edge of said custom width foam wrap to complete the wrapping procedure.

11. A method for wrapping pressure sensitive rolls of material, comprising the steps of:

(a) winding a plurality of rolls of pressure sensitive material onto winder shafts;

(b) transporting said winder shafts having plurality of rolls of pressure sensitive material thereon to an intermediate transfer cart;

(c) transferring said intermediate transfer cart to a position under a foam applicator unit;

(d) slitting a full width of foam wrap to custom widths corresponding to predetermined widths of rolls of pressure sensitive material;

(e) applying glue to a leading edge of said custom width foam wrap;

(f) deflecting said glued leading edge of foam wrap toward a respective roll of pressure sensitive material;

(g) driving said roll of pressure sensitive material to rotate a desired number of times, thereby applying a specified number of layers of custom width foam material;

(h) severing said custom width foam wrap upon completion of said specified number of wrapping layers; and (i) applying glue to the trailing edge of said custom width foam wrap to complete the wrapping procedure.

12. An apparatus for wrapping pressure sensitive rolls of material, comprising:

winding means for winding a plurality of rolls of pressure sensitive material on winder shafts, said plurality of rolls being separated by spacers on each shaft;

intermediate transfer cart means for accepting said winder shaft from said winding means, said intermediate transfer cart means including two integral lift tables for raising and lowering said plurality of rolls on said winder shafts, roll pedestals mounted on said intermediate transfer cart means for supporting said shafts, and means for adjusting the distance between said two winder shafts;

means for transferring said plurality of pressure sensitive rolls from said winding means to said intermediate transfer cart means; and foam application means for applying a layer of foam to said plurality of pressure sensitive rolls on said intermediate transfer cart means.

13. An apparatus according to claim 12, wherein said foam application unit comprises means for slitting said full width of foam wrap, means for custom wrapping various widths of pressure sensitive rolls, and means for providing a driving force to wind foam onto said pressure sensitive rolls.

14. An apparatus according to claim 12, wherein said intermediate transfer cart means further includes a coreshaft puller for removing coreshafts upon completion of said foam wrapping procedure, and an air motor for driving said coreshaft to facilitate said foam wrapping of said pressure sensitive rolls.

15. An apparatus according to claim 12, wherein said means for transferring is a bi-directional hoist which picks up said rewinder shafts and transports them to said intermediate transfer cart means.

16. An apparatus for wrapping pressure sensitive rolls of material, comprising:

winding means for winding a plurality of rolls of pressure sensitive material on window shafts, said plurality of rolls being separated by spacers on each shaft;

intermediate transfer cart means for accepting said winder shafts from said winding means;

means for transferring said plurality of pressure sensitive rolls from said winding means to said intermediate transfer cart means; and foam application means for applying a layer of foam to said plurality of pressure sensitive rolls on said intermediate transfer cart means, said foam application unit means being retractable from an operative position slightly above and between said plurality of pressure sensitive rolls on said intermediate transfer cart means to an inoperative position above said intermediate transfer cart means.

17. An apparatus according to claim 16, wherein said foam application means includes means for feeding full width foam from a supply roll to said pressure sensitive rolls, means for slitting said full foam width to custom widths corresponding to the width of said pressure sensitive rolls on said rewinder shafts, means for cutting said custom width foam after a predetermined length is received through said means for feeding, means for deflecting said custom width foam to one of said plurality of pressure sensitive rolls for wrapping said roll, and means for adhering the tail end of said custom width foam wrap to said foam wrapper roll upon completion of said wrapping procedure.

18. An apparatus according to claim 13, wherein said foam application means includes means for feeding full width foam from a supply roll to said pressure sensitive rolls, means for slitting said full foam width to custom widths corresponding to the width of said pressure sensitive rolls on said rewinder shafts, means for cutting said custom width foam after a predetermined length is received through said means for feeding, means for deflecting said custom width foam to one of said plurality of pressure sensitive rolls for wrapping said roll, and means for adhering the tail end of said custom width foam wrap to said foam wrapped roll upon completion of said wrapping procedure.

19. An apparatus for wrapping pressure sensitive rolls of material, comprising:

winding means for winding a plurality of rolls of pressure sensitive material on winder shafts, said plurality of rolls being separated by spacers on each shaft;

intermediate transfer cart means for accepting said winder shafts from said winder means, said intermediate transfer cart means including at least one integral lift table for raising and lowering said plurality of rolls on said winder shafts, roll pedestals mounted on said intermediate transfer cart means for supporting said shafts, and means for adjusting the distance between said two winder shafts.

20. An apparatus for wrapping pressure sensitive rolls of material, comprising:

winding means for winding a plurality of rolls of pressure sensitive material on winder shafts, said plurality of rolls being separated by spacers on each shaft;

intermediate transfer cart means for accepting said winder shafts from said winding means, said intermediate transfer cart means further including a coreshaft puller for removing coreshafts upon completion of wrapping pressure sensitive rolls and an air motor for driving said coreshaft to facilitate said foam wrapping of said pressure sensitive rolls;

means for transferring said plurality of pressure sensitive rolls from said winding means to said intermediate transfer cart means; and foam application means for applying a layer of foam to said plurality of pressure sensitive rolls on said intermediate transfer cart means.

* * * * *